US009556833B2

(12) United States Patent
Ozaki et al.

(10) Patent No.: US 9,556,833 B2
(45) Date of Patent: Jan. 31, 2017

(54) MOTORCYCLE

(71) Applicant: HONDA MOTOR CO., LTD., Tokyo (JP)

(72) Inventors: Yoshinobu Ozaki, Wako (JP); Ryoji Imai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 146 days.

(21) Appl. No.: 14/157,141

(22) Filed: Jan. 16, 2014

(65) Prior Publication Data

US 2014/0209060 A1 Jul. 31, 2014

(30) Foreign Application Priority Data

Jan. 30, 2013 (JP) ..... 2013-015700

(51) Int. Cl.

| | |
|---|---|
| ***F02M 35/16*** | (2006.01) |
| ***F02B 67/00*** | (2006.01) |
| ***H01T 13/02*** | (2006.01) |
| ***F02M 35/04*** | (2006.01) |

(52) U.S. Cl.

CPC ..... *F02M 35/048* (2013.01); *F02M 35/162* (2013.01)

(58) Field of Classification Search

CPC ..... F02B 75/22; F02B 61/02; F02B 75/16; F02B 27/02; F02B 27/0284; F02M 35/10321; F02M 35/10144; F02M 35/112; F02M 1/00

USPC ..... 123/195 AC, 184.21, 184.59

See application file for complete search history.

(56) References Cited

U.S. PATENT DOCUMENTS

| | | | | |
|---|---|---|---|---|
| 6,357,424 | B1 * | 3/2002 | Sonoda | F02B 61/02 123/184.21 |
| 8,522,741 | B2 * | 9/2013 | Matsuda | F02M 35/10039 123/184.21 |
| 2009/0013953 | A1 * | 1/2009 | Fujita | B01D 46/0023 123/184.21 |

FOREIGN PATENT DOCUMENTS

| | | |
|---|---|---|
| JP | 4629526 B2 | 2/2011 |

* cited by examiner

*Primary Examiner* — Lindsay Low
*Assistant Examiner* — Syed O Hasan
(74) *Attorney, Agent, or Firm* — Birch, Stewart, Kolasch & Birch, LLP

(57) ABSTRACT

An air cleaner positioned above a cylinder head is connected to an intake port of the cylinder head through a connecting tube, a throttle device, and an insulator. An insulator attachment surface is formed in a rear-side wall of a cylinder head such that the insulator attachment surface is inclined to extend in a forward direction while extending upwardly. An insulator is formed in such an arc shape in a side view wherein a flow direction of air flowing inside the insulator is directed more in a forward direction as the air approaches the cylinder head. A throttle device having an intake passage thereof directed in a vertical direction is connected to the insulator. A connecting tube is formed to curve in such a shape that the connecting tube has its upstream end opened in a forward direction and is rounded outwardly in an obliquely rearward direction.

15 Claims, 6 Drawing Sheets

MOTORCYCLE

CROSS-REFERENCE TO RELATED APPLICATIONS

The present application claims priority under 35 USC 119 to Japanese Patent Application No. 2013-015700 filed Jan. 30, 2013 the entire contents of which are hereby incorporated by reference.

BACKGROUND OF THE INVENTION

1. Field of the Invention

The present invention relates to a motorcycle wherein an engine main body includes a cylinder axis that is inclined upwardly and forwardly. A fuel tank is arranged above the engine main body. The engine and the fuel tank are mounted on a vehicle body frame. A cylinder head forming a part of the engine main body is provided with an intake port. An air cleaner is arranged above the cylinder head and is connected to the intake port through a throttle device including an intake passage. A connecting tube is provided between the throttle device and the air cleaner with a tubular insulator being provided between the throttle device and the cylinder head.

2. Description of Background Art

A motorcycle is known wherein air after being filtered by an air cleaner arranged above a cylinder head is guided into an intake port opened in a rear-side wall of the cylinder head. See, for example, Japanese Patent No. 4629526.

However, the motorcycle disclosed in Japanese Patent No. 4629526 described above includes a large air cleaner that is large in a front-rear direction of the vehicle due to a configuration wherein an insulator and a throttle device are arranged to extend obliquely rearwardly from the intake port. A connecting tube is connected to a rear portion of the air cleaner. Such a large air cleaner poses a problem of influencing the shape and the layout space of a fuel tank to be arranged behind the air cleaner. A motorcycle equipped with a large-displacement engine needs to secure large capacities for both the fuel tank and the air cleaner. Thus, there are demands for both securing the capacities and for increasing the degree of freedom in the layout.

SUMMARY AND OBJECTS OF THE INVENTION

The present invention was made in view of the foregoing circumstances. According to embodiment of the present invention, a layout of an air cleaner that has less influence on a layout space for the other components is provided for a motorcycle.

For the purpose of achieving the foregoing object, according to an embodiment of the present invention a motorcycle is provided wherein an engine main body includes a cylinder axis that is inclined upwardly and forwardly. A fuel tank is arranged above the engine main body. The engine and the fuel tank are mounted on a vehicle body frame. A cylinder head forming a part of the engine main body is provided with an intake port with an air cleaner arranged above the cylinder head being connected to the intake port through a throttle device including an intake passage. A connecting tube is provided between the throttle device and the air cleaner with a tubular insulator provided between the throttle device and the cylinder head. An insulator attachment surface is provided where the intake port is opened and is formed in a rear-side wall of the cylinder head such that the insulator attachment surface is inclined to extend in a forward direction while extending upwardly. The insulator attached to the insulator attachment surface is formed in an arc shape in a side view wherein a flow direction of air flowing inside the insulator is directed more in a forward direction as the air approaches the cylinder head. The throttle device having the intake passage directed in a vertical direction is connected to the insulator. The connecting tube is formed to curve in such a shape wherein the connecting tube has its upstream end opened in a forward direction and is rounded outwardly in an obliquely rearward direction to connect the air cleaner and the throttle device to each other.

In addition to the configuration of the first feature, according to an embodiment of the present invention the fuel tank is mounted on the vehicle body frame in such a manner so as to cover at least a rear portion of the air cleaner in a plan view and a side view.

According to an embodiment of the present invention, the upstream end of the connecting tube is connected to a rear portion of the air cleaner.

According to an embodiment of the present invention, a fuel injection device is attached to a front wall of the throttle device.

According to an embodiment of the present invention, the fuel injection device is set to be directed to a rear-side inner wall surface of a downstream end portion of the insulator.

According to an embodiment of the present invention, a most-rear end of the air cleaner is arranged in a forward direction of a most-rear end of a cylinder block included in the engine main body.

According to an embodiment of the present invention, the vehicle body frame includes a head pipe supporting a front fork in a steerable manner, the front fork supporting a front wheel rotatably, and a pair of left and right main frames extending rearwardly from the head pipe. The air cleaner includes a pair of left and right extension portions extending outwardly on both sides in a vehicle width direction in such a manner so as to straddle the pair of left and right main frames.

According to an embodiment of the present invention, an intake duct is provided to extend from at least one of the pair of left and right extension portions with a cleaner element being housed inside the extension portion, to which the intake duct is contiguous, out of the two extension portions.

It should be noted that throttle bodies 45 in embodiments are equivalent to the throttle device of the present invention, and fuel injection valves 52 in the embodiments are equivalent to the fuel injection device of the present invention.

According to an embodiment of the present invention, the insulator attachment surface formed in the rear-side wall of the cylinder head is inclined to extend in a forward direction while extending upwardly. The insulator is formed in an arc shape in the side view such that the flow direction of the air flowing inside the insulator is directed more in a forward direction as the air approaches the cylinder head. The throttle device is connected to the insulator with the intake passage directed in the vertical direction. The connecting tube is formed to curve in such a shape that the connecting tube has its upstream end opened in a forward direction and is rounded outwardly in the obliquely rearward direction. Thus, the connecting portion of the connecting tube to the air cleaner and the connecting portion of the insulator to the cylinder head can be made closer to the vehicle front side than ever. Thus, a space behind the air cleaner is widened to thereby secure a layout space for other components to be arranged behind the air cleaner.

According to an embodiment of the present invention, the fuel tank is arranged above the engine main body and is mounted on the vehicle body frame for covering at least the rear portion of the air cleaner in the plan view and the side view. This makes it possible to secure a capacity of the fuel tank and to prevent the knees of a passenger from coming into contact with the air cleaner.

According to an embodiment of the present invention, the upstream end of the connecting tube is connected to the rear portion of the air cleaner. Thus, the air cleaner can be arranged as close as possible to the vehicle front side, which can contribute toward securing the capacity of the fuel tank.

According to an embodiment of the present invention, the attachment of the fuel injection device to the front wall of the throttle device eliminates the necessity of a layout space for the fuel injection device behind the throttle device. Accordingly, it is possible to further increase the capacity of the fuel tank.

According to an embodiment of the present invention, the fuel injection device is arranged in a posture extending in the vertical direction to secure a clearance between the cylinder head and the fuel injection device. Thus, the workability in attaching a lead wire and the like to the fuel injection device is improved.

According to an embodiment of the present invention, the most-rear end of the air cleaner is arranged in a forward direction of the most-rear end of the cylinder block. Thereby, a space behind the cylinder block is secured and various components are arranged close to each other behind the cylinder block, which can contribute to the centralization of mass.

According to an embodiment of the present invention, the capacity of the air cleaner can be secured because the air cleaner includes the pair of left and right extension portions extending outwardly on both sides in the vehicle width direction in such a manner so as to straddle the pair of left and right main frames extending rearwardly from the head pipe.

Furthermore, according to an embodiment of the present invention, the intake duct is provided to extend from at least one of the pair of left and right extension portions, and the cleaner element is housed inside the extension portion to which the intake duct is contiguous. Thereby, a sufficiently-large capacity can be secured for a clean room in the air cleaner.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
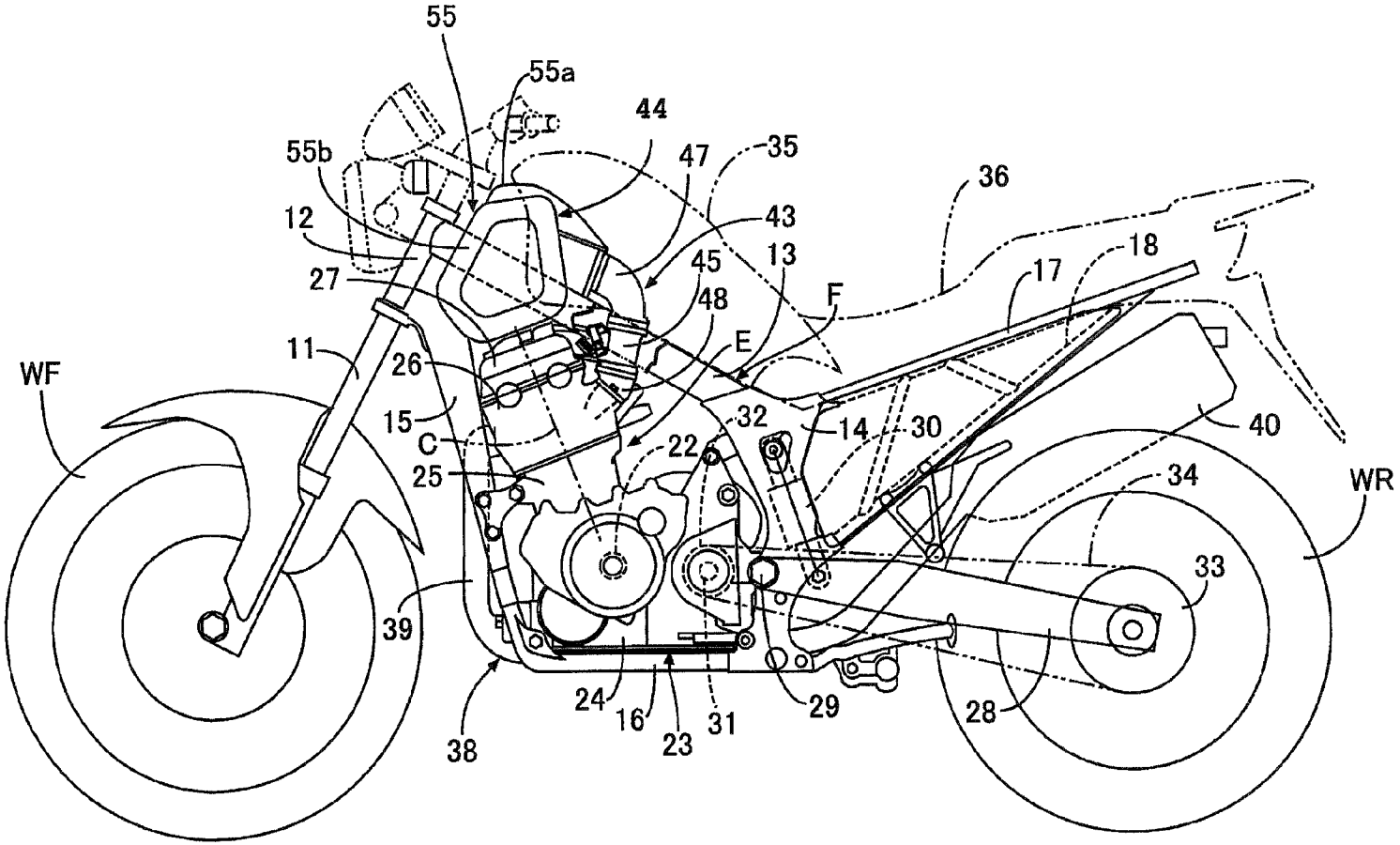
FIG. 1 is a left-side view of a motorcycle according to a first embodiment.
Figure 2:
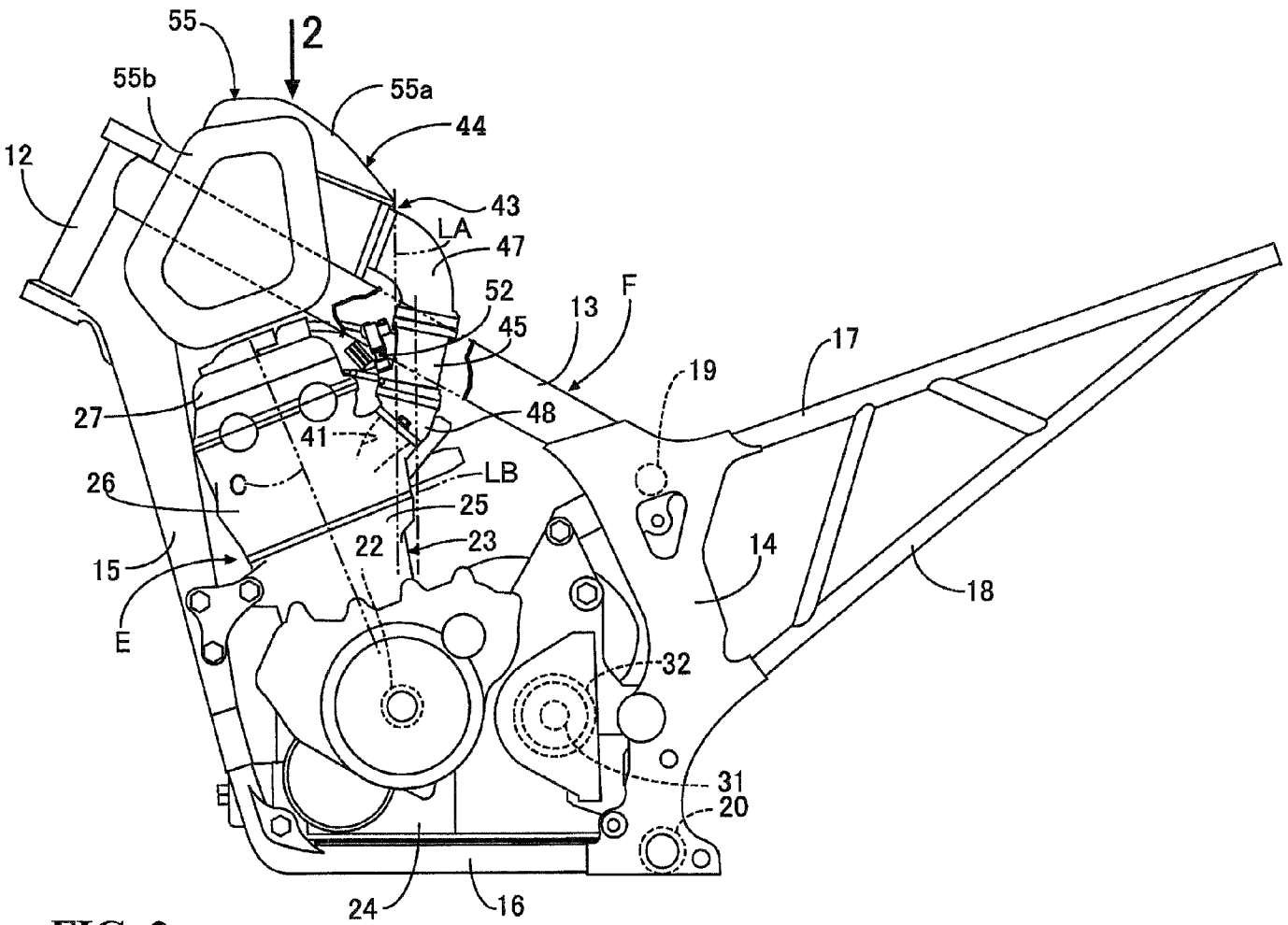
FIG. 2 is a left-side view of a vehicle body frame and an engine.
Figure 3:
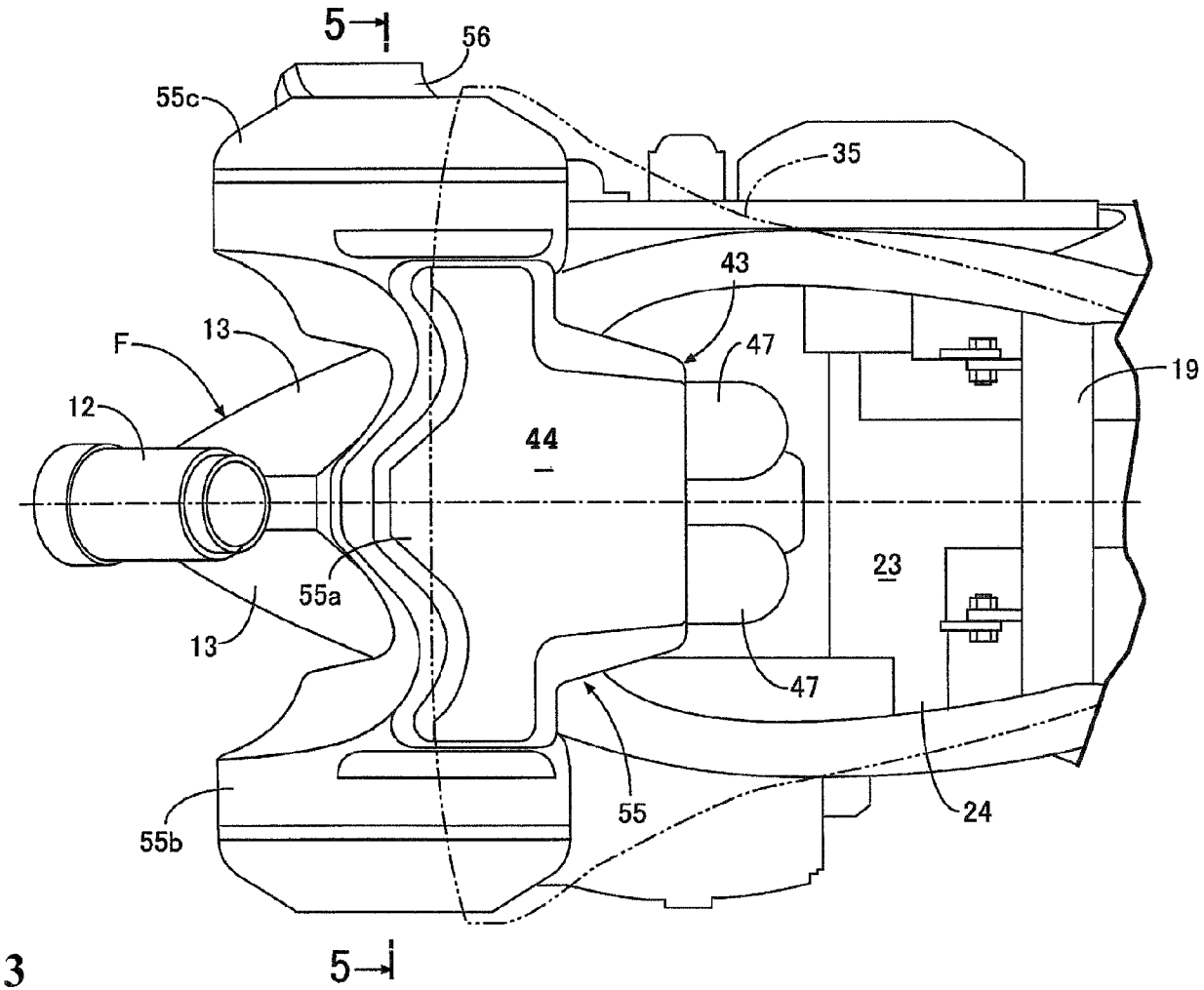
FIG. 3 is a view on arrow 2 in FIG. 2.

Embodiments of the present invention are described with reference to the accompanying drawings. In the following description, front, rear, left, right, upward and downward indicate directions viewed from a passenger who rides on the motorcycle.

A first embodiment of the present invention is described with reference to FIGS. 1 to 5. To begin with, in FIGS. 1 and 2, a vehicle body frame F of this motorcycle includes a head pipe 12 supporting a front fork 11 in a steerable manner. The front fork 11 rotatably supports a front wheel WF at a lower end portion thereof. A pair of left and right main frames 13 extend downwardly and rearwardly from the head pipe 12 with a pair of left and right pivot frames 14 extending downwardly from rear ends of the main frames 13. A down frame 15 extends downwardly and rearwardly from the head pipe 12 while inclining at a steeper angle than the main frames 13 incline. A pair of left and right lower frames 16 connect a rear end of the down frame 15 to both the pivot frames 14. A pair of left and right seat rails 17 extend upwardly and rearwardly from upper portions of the pivot frames 14 with a pair of left and right rear frames 18 extending upwardly and rearwardly while connecting lower portions of the respective pivot frames 14 to middle portions of the respective seat rails 17. An upper cross member 19 connects upper portions of the respective pivot frames 14 to each other with a lower cross member 20 connecting lower portions of the respective pivot frames 14 to each other.

In the vehicle body frame F, an engine main body 23 of a two-cylinder inline engine E is mounted in such a manner so as to be surrounded by the main frames 13, the pivot frames 14, the down frame 15 and the lower frames 16. The engine main body 23 includes a crank case 24 rotatably supporting a crankshaft 22 having its axis extending in a vehicle width direction with a cylinder block 25 joined to a front upper portion of the crank case 24 with a cylinder axis C inclined upwardly in a forward direction. A cylinder head 26 is joined to an upper portion of the cylinder block 25 with a head cover 27 joined to an upper portion of the cylinder head 26.

A front end portion of a swing arm 28 is supported by lower portions of the pivot frames 14 through a support shaft 29 in such a manner the swing arm 28 can swing up and down. A rear wheel WR is rotatably supported by rear portions of the swing arm 28. A rear shock absorber unit 30 is provided between the upper cross member 19 and the swing arm 28.

A transmission (not illustrated) for speed change of rotational power of the crankshaft 22 is housed inside the crank case 24 of the engine main body 23. An output shaft 31 of the transmission protrudes leftward from the crank case 24. An endless chain 34 is wound around a driving sprocket 32 fixed to an end portion of the output shaft 31 and a driven sprocket 33 provided coaxially to the rear wheel WR. The output of the transmission is transmitted to the rear wheel WR via the chain 34.

A fuel tank 35 is mounted on the pair of left and right main frames 13 above the engine main body 23 in such a manner so as to straddle the main frames 13. A tandem-type passenger seat 36 is arranged behind the fuel tank 35, and the passenger seat 36 is supported by both the seat rails 17.

An air exhauster 38 is connected to a front-side wall of the cylinder head 26 constituting a part of the engine main body 23. The air exhauster 38 includes exhaust pipes 39 having their upstream ends connected to the front-side wall of the cylinder head 26 corresponding to the respective cylinders, passing under the engine main body 23 and further extending rearward, and an exhaust muffler 40 extending continuously from both the exhaust pipes 39 and arranged on the right side of the rear wheel WR.

Figure 4:
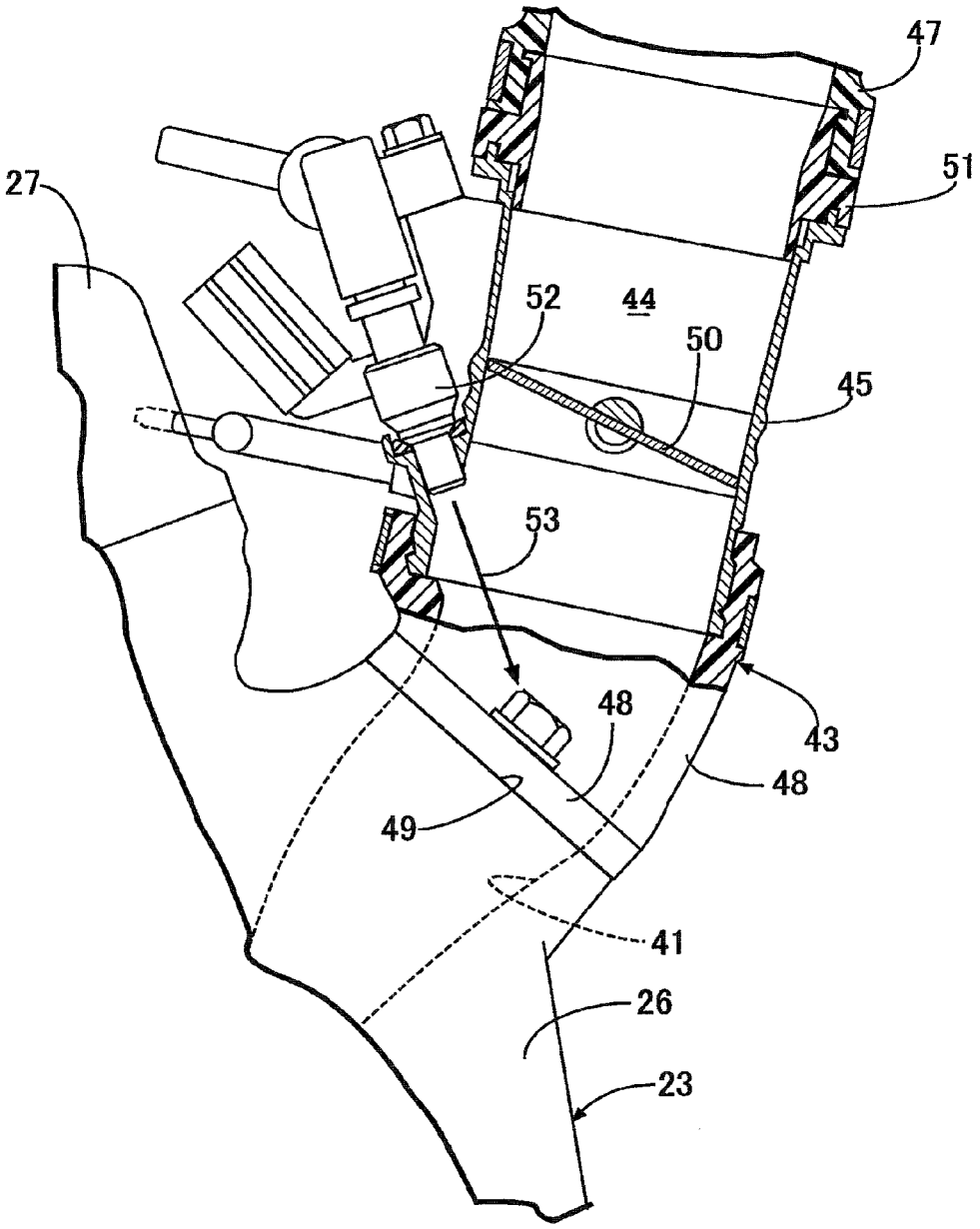
FIG. 4 is a cutout side view illustrating a part of an intake device.

In addition, referring to FIG. 4, a rear-side wall of the cylinder head 26 is provided with intake ports 41 for the respective cylinders, and an intake device 43 contiguous with the intake ports 41 is connected to the rear-side wall of the cylinder head 26.

The intake device 43 includes an air cleaner 44 provided above the cylinder head 26 and being common to the cylinders with throttle bodies 45 including intake passages 46 for the respective cylinders, and disposed under the air cleaner 44 with the intake passages 46 directed in the vertical direction. The throttle bodies 45 serve as a throttle device with connecting tubes 47 connecting upstream ends of the throttle bodies 45 to the air cleaner 44. Tubular insulators 48 are provided between downstream ends of the throttle bodies 45 and the cylinder head 26.

In the rear-side wall of the cylinder head 26, insulator attachment surfaces 49 in which the respective intake ports 41 are opened are formed for the respective cylinders. The insulator attachment surfaces 49 are inclined to extend in a forward direction while extending upwardly. The insulators 48 attached to the insulator attachment surfaces 49 are each formed in such an arc shape in a side view that a flow direction of air flowing inside the insulator 48 is directed more in a forward direction as the air approaches the cylinder head 26.

Each throttle body 45 is connected to an upstream end of the corresponding insulator 48 with the intake passage 46 thereof directed in the vertical direction. The throttle body 45 is provided with a throttle valve 50 in a butterfly shape configured to adjust an opening degree of the intake passage 46.

Meanwhile, the fuel tank 35 is arranged to cover at least a rear portion of the air cleaner 44 in a plan view and a side view. In this embodiment, the fuel tank 35 is arranged such that a front portion of the fuel tank 35 covers the rear portion of the air cleaner 44 in the plan view and the side view. A downstream end of each connecting tube 47 is connected to the upstream end of the corresponding throttle body 45 with a joint member 51 interposed in between. The connecting tube 47 is formed to curve in such a shape that the connecting tube 47 has its upstream end opened in a forward direction and is rounded outward in an obliquely rearward direction to connect the rear portion of the air cleaner 44 and the upper portion of the throttle body 45 to each other.

A fuel injection valve 52 as a fuel injection device is attached to a front wall of the throttle body 45. An injection direction 53 of the fuel injection valve 52 is set to be directed to a rear-side inner wall surface of a downstream end portion of the corresponding insulator 48.

Figure 5:
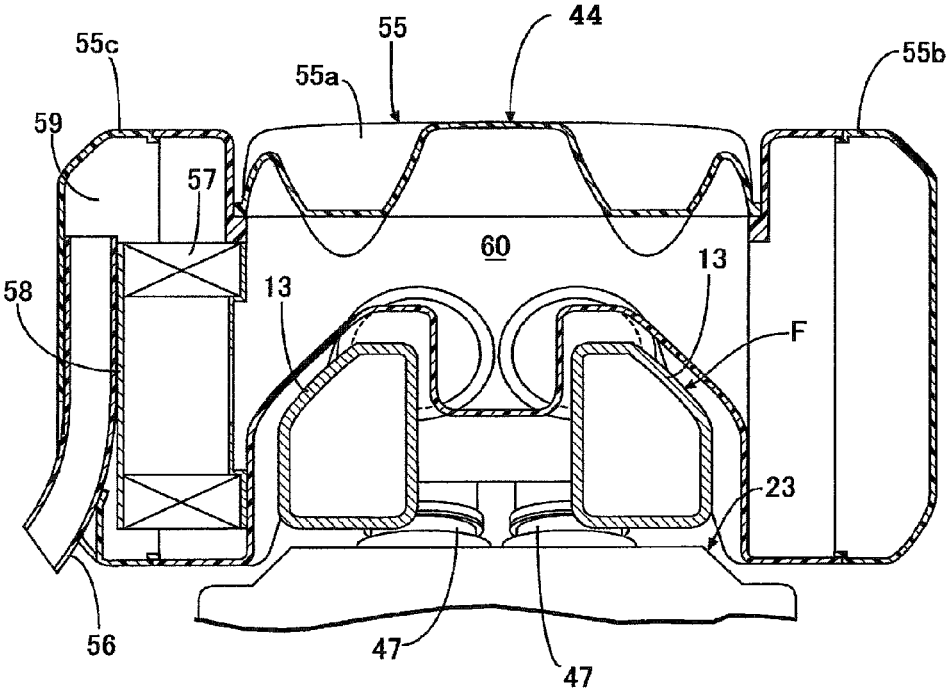
FIG. 5 is a cross sectional view taken along a line 5-5 in FIG. 3.

In addition, referring to FIG. 5, a cleaner case 55 of the air cleaner 44 is formed to include a case main portion 55*a* arranged above the pair of left and right main frames 13, 13 of the vehicle body frame F, and a pair of left and right extension portions 55*b*, 55*c* extending outwardly on both sides in the vehicle width direction in such a manner so as to straddle the main frames 13, 13 from the case main portion 55*a*. An intake duct 56 is provided to extend in a forward direction obliquely rightward from at least one of the pair of left and right extension portions 55*b*, 55*c*, i.e., the right extension portion 55*c* in this embodiment.

A cleaner element 57 in a cylindrical shape supported by a filter support frame 58 is housed in the extension portion 55*c*, to which the intake duct 56 is contiguous, out of the two extension portions 55*b*, 55*c* of the air cleaner 44. The inside of the cleaner case 55 is formed into a dirty room 59 that surrounds the cleaner element 57 inside the extension portion 55*c*, and a clean room 60 that ranges over the case main portion 55*a* and the left extension portion 55*b* from a portion surrounded by the cleaner element 57 inside the extension portion 55*c*. The connecting tubes 47, 47 are connected to rear portions of the case main portion 55*a* so as to communicate with the clean room 60.

In addition, the most-rear end of the air cleaner 44 is arranged in a forward direction of the most-rear end of the cylinder block 25 constituting a part of the engine main body 23. Thus, a vertical line LA passing through the most-rear end of the air cleaner 44 is located in a forward direction of a vertical line LB passing through the most-rear end of the cylinder block 25.

Next, effects of this first embodiment are described. Each insulator attachment surface 49 where the intake port 41 is opened is formed in the rear-side wall of the cylinder head 26 such that the insulator attachment surface 49 is inclined to extend in a forward direction while extending upwardly. Each insulator 48 attached to the corresponding insulator attachment surface 49 is formed in such an arc shape in the side view that the flow direction of air flowing inside the insulator 48 is directed more in a forward direction as the air approaches the cylinder head 26. Each throttle body 45 is connected to the corresponding insulator 48 with the intake passage 46 thereof directed in the vertical direction. Each connecting tube 47 is formed to curve in such a shape that the connecting tube 47 has its upstream end opened in a forward direction and is rounded outward in the obliquely rearward direction to connect the air cleaner 44 and the corresponding throttle body 45 to each other. Thus, the connecting portions of the connecting tubes 47 to the air cleaner 44 and the connecting portions of the insulators 48 to the cylinder head 26 can be made closer to the vehicle front side than ever, which widens a space behind the air cleaner 44 to thereby make it possible to secure a layout space for other components such as the fuel tank 35 to be arranged behind the air cleaner 44.

In addition, the fuel tank 35 arranged above the engine main body 23 is mounted on the vehicle body frame F such that the fuel tank 35 covers at least the rear portion of the air cleaner 44 in the plan view and the side view. This makes it possible to secure a capacity of the fuel tank 35 and to prevent the knees of a passenger from coming into contact with the air cleaner 44.

Moreover, since the upstream ends of the connecting tubes 47 are connected to the rear portions of the air cleaner 44, the air cleaner 44 can be arranged as close as possible to the vehicle front side, which can contribute toward securing the capacity of the fuel tank 35.

Further, the attachment of the fuel injection valves 52 to the front walls of the throttle bodies 45 eliminates the necessity of a layout space for the fuel injection valves 52 behind the throttle bodies 45. Accordingly it is then possible to further increase the capacity of the fuel tank 35.

Since the injection direction 53 of each of the fuel injection valves 52 is set to be directed to the rear-side inner wall surface of the downstream end portion of the corresponding insulator 48, the fuel injection valve 52 is arranged in a posture extending in the vertical direction to secure a clearance between the cylinder head 26 and the fuel injection valve 52, which enables an improvement in the workability in attaching a lead wire and the like to the fuel injection valve 52.

Since the most-rear end of the air cleaner 44 is arranged in a forward direction of the most-rear end of the cylinder block 25, a space behind the cylinder block 25 is secured and various components are arranged close to each other behind the cylinder block 25, which can contribute to the centralization of mass.

Furthermore, since the air cleaner 44 includes the pair of left and right extension portions 55*b*, 55*c* extending outward on both sides in the vehicle width direction in such a manner as to straddle a pair of left and right main frames 13, the capacity of the air cleaner 44 can be secured. In addition, the intake duct 56 is provided to extend from at least one of the pair of left and right extension portions 55*b*, 55*c* (55*c* in this embodiment), and the cleaner element 57 is housed inside the extension portion 55*c*, to which the intake duct 56 is contiguous, out of the two extension portions 55*b*, 55*c*. Thereby, a sufficiently-large capacity can be secured for the clean room 60 in the air cleaner 44.

Figure 6:
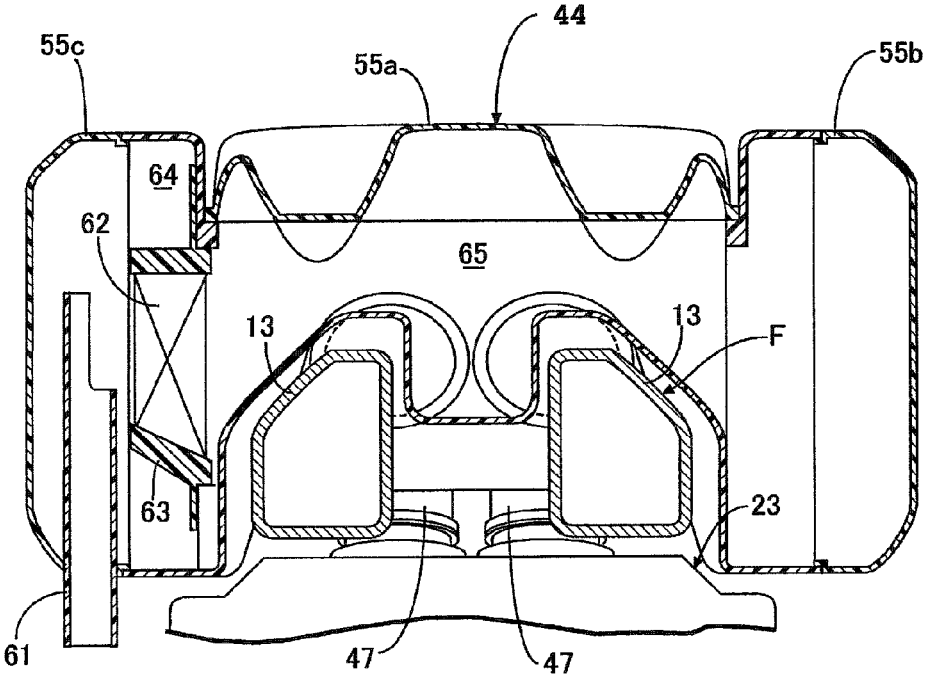
FIG. 6 is a cross sectional view of a second embodiment corresponding to FIG. 5.

A second embodiment of the present invention is described with reference to FIG. 6. In the description, components equivalent to those in the first embodiment are given the same reference numerals and are only illustrated in the drawing, while the detailed description thereof is omitted.

An intake duct 61 is provided to extend in a forward direction from at least one of the pair of left and right extension portions 55*b*, 55*c* included in the air cleaner 44, i.e., the right extension portion 55*c* in this embodiment. A cleaner element 62 in a disc-like shape supported by a filter support frame 63 is housed inside the extension portion 55*c* to which the intake duct 61 is contiguous. Thus, the inside of the cleaner case 55 is formed into a dirty room 64 being a part inside the extension portion 55*c* excluding the cleaner element 62, and a clean room 65 inside the case main portion 55*a* and the left extension portion 55*b*. The connecting tubes 47, 47 are connected to the rear portions of the case main portion 55*a* so as to communicate with the clean room 65.

This second embodiment can produce the same or similar effects to the first embodiment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A motorcycle wherein an engine main body includes a cylinder axis inclined upwardly in a forward direction of the motorcycle and a fuel tank arranged above the engine main body and mounted on a vehicle body frame, a cylinder head constituting a part of the engine main body is provided with an intake port with an air cleaner arranged above the cylinder head being connected to the intake port through a throttle device including an intake passage, a connecting tube is provided between the throttle device and the air cleaner, and a tubular insulator is provided between the throttle device and the cylinder head, wherein: an insulator attachment surface where the intake port is opened is formed in a rear-side wall of the cylinder head such that the insulator attachment surface is inclined to extend in the forward direction of the motorcycle while extending upwardly; the tubular insulator attached to the insulator attachment surface is formed in an arc shape in a lateral side view of the motorcycle, wherein a contour of the are shape facing a rearward direction of the motorcycle is longer than a contour of the arc shape facing the forward direction of the motorcycle such that a flow direction of air flowing inside the tubular insulator is turned more in the forward direction of the motorcycle as the air approaches the cylinder head; the throttle device having the intake passage directed in a vertical direction is connected to the tubular insulator; the connecting tube is formed in a curved shape wherein the connecting tube has its upstream end opened in the forward direction of the motorcycle and is rounded outwardly in an obliquely rearward direction while connecting the air cleaner and the throttle device to each other, and a contour of the curved shape of the connecting tube facing the rearward direction of the motorcycle is longer than a contour of the curved shape of the connecting tube facing the forward direction of the motorcycle; and a most-rear end of the air cleaner is arranged in a forward direction of a most-rear end of a cylinder block included in the engine main body.

2. The motorcycle according to claim 1, wherein the fuel tank is mounted on the vehicle body frame for covering at least a rear portion of the air cleaner in a plan view and a side view.

3. The motorcycle according to claim 1, wherein the upstream end of the connecting tube is connected to a rear portion of the air cleaner.

4. The motorcycle according to claim 1, wherein a fuel injection device is attached to a front wall of the throttle device.

5. The motorcycle according to claim 2, wherein a fuel injection device is attached to a front wall of the throttle device.

6. The motorcycle according to claim 3, wherein a fuel injection device is attached to a front wall of the throttle device.

7. The motorcycle according to claim 4, wherein an injection direction of the fuel injection device is set to be directed to a rear-side inner wall surface of a downstream end portion of the insulator.

8. The motorcycle according to claim 1, wherein:

an intake duct is provided to extend from at least one of the pair of left and right extension portions, and a cleaner element is housed inside the extension portion, to which the intake duct is contiguous, out of the two extension portions.

9. The motorcycle according to claim 1, wherein the vehicle body frame includes a pair of left and right main frames extending rearwardly from a head pipe;

the air cleaner includes a pair of left and right extension portions extending outwardly on both sides in a vehicle width direction to straddle the pair of left and right main frames; and an air cleaner element being positioned within at least one of the left and right extension portions operatively connected to the intake port.

10. A motorcycle comprising: an engine main body includes a cylinder head with a cylinder axis inclined upwardly in a forward direction of the motorcycle; an intake port in communication with the cylinder head; an air cleaner arranged above the cylinder head and being connected to the intake port through a throttle device including an intake passage; a connecting tube provided between the throttle device and the air cleaner; a tubular insulator provided between the throttle device and the cylinder head; an insulator attachment surface where the intake port is opened is formed in a rear-side wall of the cylinder head such that the insulator attachment surface is inclined to extend in the forward direction of the motorcycle while extending upwardly; the tubular insulator being attached to the insulator attachment surface and being formed in an arc shape in a lateral side view of the motorcycle, wherein a contour of the are shape facing a rearward direction of the motorcycle is longer than a contour of the are shape facing the forward direction of the motorcycle such that a flow direction of air flowing inside the tubular insulator is turned more in the forward direction of the motorcycle as the air approaches the cylinder head; the throttle device having the intake passage directed in a vertical direction is connected to the tubular insulator; the connecting tube is formed in a curved shape wherein the connecting tube has its upstream end opened in the forward direction of the motorcycle and is rounded outwardly in an obliquely rearward direction while connecting the air cleaner and the throttle device to each other, and a contour of the curved shape of the connecting tube facing the rearward direction of the motorcycle is longer than a contour of the curved shape of the connecting tube facing the forward direction of the motorcycle; and a most-rear end of the air cleaner is arranged in a forward direction of a most-rear end of a cylinder block included in the engine main body.

11. The motorcycle according to claim 10, wherein a fuel tank is mounted on a vehicle body frame for covering at least a rear portion of the air cleaner in a plan view and a side view.

12. The motorcycle according to claim 10, wherein the upstream end of the connecting tube is connected to a rear portion of the air cleaner.

13. The motorcycle according to claim 10, wherein a fuel injection device is attached to a front wall of the throttle device.

14. The motorcycle according to claim 13, wherein an injection direction of the fuel injection device is set to be directed to a rear-side inner wall surface of a downstream end portion of the insulator.

15. The motorcycle according to claim 10, wherein the vehicle body frame includes a pair of left and right main frames extending rearwardly from a head pipe;

the air cleaner includes a pair of left and right extension portions extending outwardly on both sides in a vehicle width direction to straddle the pair of left and right main frames; and an air cleaner element being positioned within at least one of the left and right extension portions operatively connected to the intake port.

* * * * *